United States Patent [19]

Jones et al.

[11] Patent Number: 4,764,129

[45] Date of Patent: Aug. 16, 1988

[54] ELECTRICAL CONNECTOR ASSEMBLIES

[75] Inventors: Brian Jones; Graeme S. Allan, both of Solihull, England

[73] Assignee: British Telecommunications plc, United Kingdom

[21] Appl. No.: 785,557

[22] Filed: Oct. 8, 1985

[30] Foreign Application Priority Data

Oct. 9, 1984 [GB] United Kingdom ..... 8424447

[51] Int. Cl.[4] ..... H01R 13/69

[52] U.S. Cl. ..... 439/677; 439/680

[58] Field of Search ..... 339/186 R, 186 M, 184 R, 339/184 M; 439/677, 679, 680, 681

[56] References Cited

U.S. PATENT DOCUMENTS 2,958,014 10/1960 Blain ..... 339/184 M
3,275,765 9/1966 Ferdon et al. ..... 339/186 M

FOREIGN PATENT DOCUMENTS 616550 7/1935 Fed. Rep. of Germany .
706495 4/1941 Fed. Rep. of Germany .
0708208 7/1941 Fed. Rep. of Germany ..... 439/677
2243825 3/1974 Fed. Rep. of Germany .
1318542 1/1963 France .
7309595 1/1974 Netherlands .
0398769 2/1889 United Kingdom ..... 439/679
0832658 4/1960 United Kingdom ..... 339/184 R

*Primary Examiner*—Eugene F. Desmond
*Attorney, Agent, or Firm*—Nixon & Vanderhye

[57] ABSTRACT

A series of electrical connector assemblies each comprising plugs and corresponding sockets which are of a number of different widths. Narrower plugs of the series are prevented from insertion into wider sockets of the series by the variation of the height of the plugs and sockets and or the cross-sectional dimensions of a key and keyway provided on the plugs and sockets. Further differentiation, between plugs and sockets of the same width, is achieved by variation of the location of the key and keyway on the plug and socket sidewalls and or the cross-sectional dimensions of the keys and keyways.

8 Claims, 2 Drawing Sheets

20
21
22

23
24
25
26

18
19
10
11
12
13
14
15
16
17
$w_k$
$h_k$
$h_k$
$w_p$
$h_p$ 1
2
3
4
5
6
7
8
9

ELECTRICAL CONNECTOR ASSEMBLIES

FIELD OF THE INVENTION

This invention relates to a series of electrical connector assemblies and in particular those comprising a socket and a corresponding plug which is received in the socket.

BACKGROUND OF THE INVENTION

Connector assemblies of this general type are now commonly used for connecting subscribers telephone apparatus to the public network; use of a socket and plug allowing easy movement or replacement of the telephone. For such use plugs and sockets having 4 or 6 terminals in plugs and sockets of the same overall sizes are usually used. Such assemblies can be easily mass produced using injection moulding and automatic assembly techniques. However, there is now a considerable need for a series of electrical connectors of the same general type having a larger number of terminals. This is particularly so in the telecommunications and computer related fields.

In producing a series of connectors having a varying number of terminals it is convenient for the various members of the series to differ only in the width of the engageable portion of the plug and the corresponding socket recess. This can lead to smaller plugs being inadvertently inserted into larger sockets which can result in damage to either or both of the pieces of equipment so connected. Even if plugs and sockets of the same size are being connected it is often desirable to prevent plugs intended for a particular purpose from being inserted into sockets of the same size intended for some other purpose. Keying systems to prevent both such mismatchings are known but involve the use of a number of complicated systems each requiring many keys and keyways to avoid any mismatching of plugs and sockets. Such systems also require an overly complicated series of moulds.

SUMMARY OF THE INVENTION

According to the present invention there is provided a series of electrical connector assemblies each assembly comprising a socket and a corresponding plug and having a coding key and keyway; each plug having an engageable portion for engaging in said corresponding socket, said portion comprising a first pair of opposed plug sidewalls and a second pair of opposed plug sidewalls disposed transversely to said first pair of plug sidewalls, said sidewalls extending in the direction of engagement with said socket, one or more terminals each for contacting one or more corresponding terminals in said corresponding socket and one of said coding key or keyway for engaging the other of said coding key or keyway located in said socket; each socket having a recess for receiving said engageable portion of said plug, said recess comprising a first pair of opposed recess sidewalls a second pair of opposed recess sidewalls disposed transversely to said first pair of recess sidewalls, one or more terminals each for contacting one or more corresponding terminals on said plug and the other of said coding key or keyway for engaging the key or keyway on said plug, the width of said engageable portions and said corresponding recesses as measured between said first pairs of sidewalls being different for each of the assemblies of the series wherein one or more of the height of said engageable portion and recess as measured between said second sidewalls and the cross-sectional dimensions of said key and keyway of each assembly of said series as viewed in the direction of engagement of said plug and socket are dimensioned to prevent insertion of narrower plugs of the series into wider sockets of the series having a recess width as measured between said first pair of recess sidewalls which is greater than the width between said first plug sidewalls of said narrower plugs.

Since the series of assemblies need only have one coding key and keyway, visual inspection to determine whether a plug will fit a particular socket is rendered easy. The design of the plugs and sockets is also rendered simple since they each require only one coding key and keyway. Though only one coding key and keyway is required, other locating or coding keys and keyways may be added if required for particular purposes. The height of the plugs and sockets together with the cross-sectional dimensions of the keys and keyways may be combination prevent mismatching of narrower plugs with wider sockets. Preferably though the heights of the engageable portions of the narrower plugs are greater than the heights of the recesses of the wider sockets as measured between each of their second pairs of sidewalls so that the height referred to above prevents mismatching of narrower and wider members of the series. Using the height of the plug in this way enables the coding keys and keyways of the assemblies to be used to provide two further levels of series of coding if required. The cross-sectional dimensions of the coding keys and keyways as viewed in the direction of the engagement of the plug and socket and optionally their location may, however, be the same for all members of the series and no further coding provided. Alternatively the coding key and keyway may have different cross-sectional dimensions as viewed in the direction of engagement of said plug and socket to prevent insertion of plugs of assemblies of said sub-series in other sockets of said sub-series. Whether or not the cross-sectional dimensions of the coding keys and keyways are varied their position on the sidewall they are located on may be varied for each of the members of the series to prevent plugs of members of this further sub-series from being inserted into sockets of other members of the further sub-series.

Alternatively, instead of varying the height of the engageable portions and recesses to prevent narrow plugs from being inserted into wider sockets the cross-sectional dimensions of the coding key and keyway may be made different for each member of the series of assemblies in order to fulfil this function. The coding key may be provided on either the plugs or recesses of the assemblies. If it is provided on the plugs one ore more of the cross-sectional dimensions of the keys and keyways are larger for the narrower plugs than for the wider sockets of the series. Conversely, if the keys are provided on the sockets one or more of the cross-sectional dimensions of the keys and keyways are smaller for the narrower plugs than for the wider sockets of the series.

The cross-sectional dimensions of the keys and keyways may be varied as above whilst preferably keeping the heights of the engageable portions and recesses as measured between their second pairs of sidewalls the same. This height though may be allowed to vary within certain limits if the variation in cross-sectional dimensions of the coding keys and keyways is always sufficient to prevent narrower plugs fitting into wider sockets.

In varying the cross-sectional dimensions of the coding key and keyway the height of the coding key and keyway as measured in the direction between the second pairs of sidewalls may be made different for all members of the series. When the coding keys are located on the plugs the keys and keyways are of greater height for those assemblies with narrower sockets. Conversely when the coding keys are located in the sockets the keys and keyways are of greater height for those assemblies with wider sockets. Alternatively or additionally the width of the coding key and keyway may also be varied as measured in the direction between said first pairs of sidewalls. When the coding keys are located on the plugs the keys and keyways are preferably of greater width for those assemblies with narrower sockets. Conversely when the coding keys are located in the sockets the keys and keyways are of greater width for those assemblies with wider sockets.

Again a further level of coding may be provided when the cross-sectional dimensions of the coding key and keyway are used to prevent mismatching of narrower plugs with wider sockets by forming for each member of the series of assemblies a sub-series of assemblies wherein the coding key and keyway is located at a different position on one of the sidewalls for each member of the sub-series to prevent insertion of plugs of assemblies of the sub-series into sockets of the assemblies of the sub-series.

Such an arrangement enables a single coding key and keyway to provide two levels of coding. One which prevents narrower plugs being inserted into wider sockets and the other which allows differentiation between plugs and sockets of the same width. This dual coding system is considerably simpler than any system using a plurality of different sets of keys and keyways to provide two such levels of coding and the design and manufacture of plugs according to the present invention is thus greatly simplified.

In making the assemblies according to the present invention it is possible to have the keys located either on the plugs or in the sockets. Preferably however the keys are provided on the plugs to enable the plug's engageable portion to be reduced in height to the minimum required by the cable to be inserted into the plug and connected to the terminals. It is also possible to locate the keys and keyways on either the first or second pairs of sidewalls provided always that narrower plugs are prevented from being inserted into wider sockets by the height of the engageable portion of the plug and or the cross-sectional dimensions of the key and keyway. However it is much preferrred to locate the key and keyway on the second pairs of sidewalls since this avoids the need for extremely lengthy keys and keyways which can in certain circumstances be necessary if they are located on the first sidewall and the narrower plugs are not of greater height than the wider sockets.

BRIEF DESCRIPTION OF THE DRAWINGS

Preferred embodiments of the present invention will now be described with reference to the following drawings in which.

DETAILED DESCRIPTION

Figures 1, 2, 3, 4, 5:
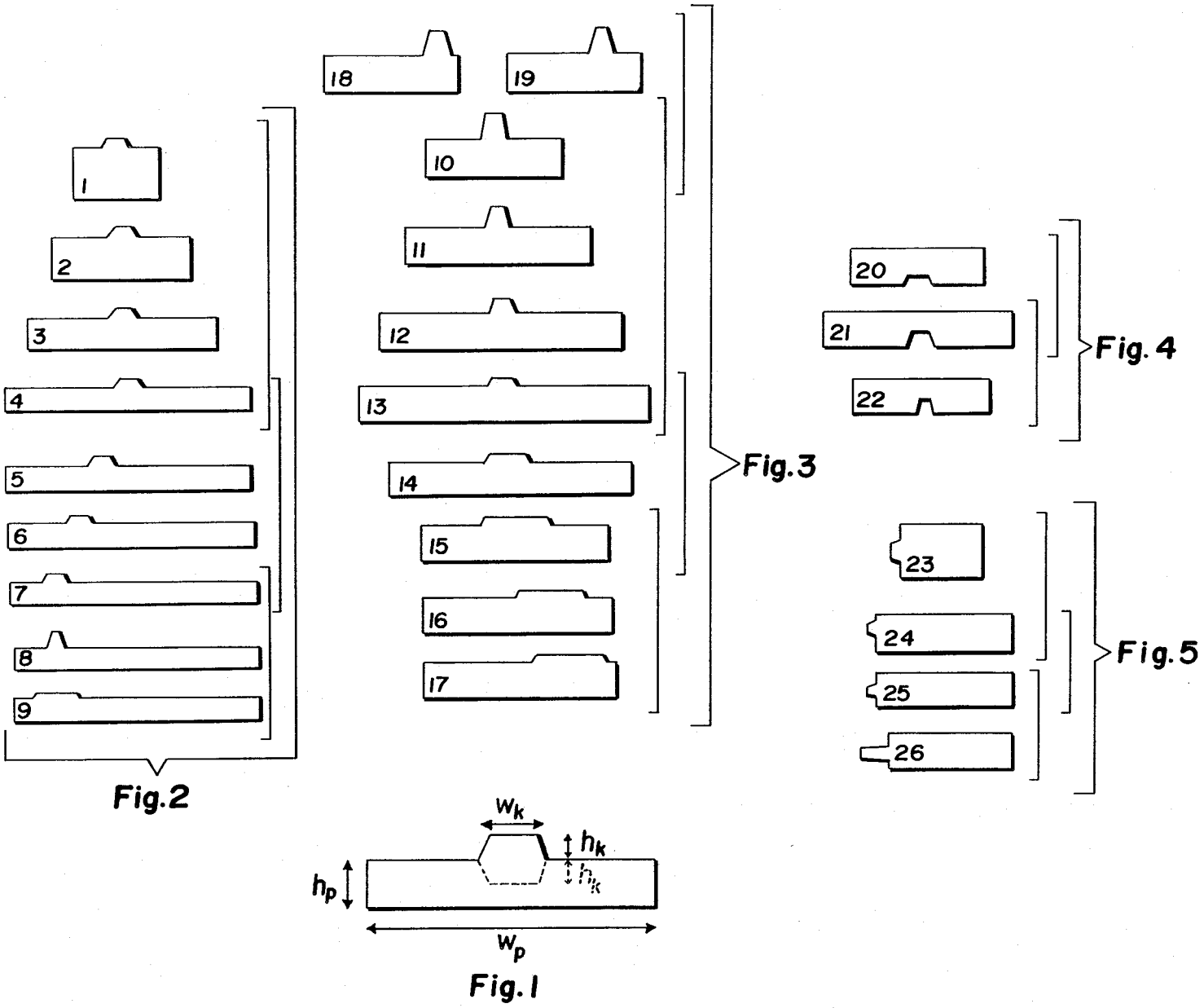
FIG. 1 shows a schematic end-on view in the direction of engagement of the plug and socket of the disposition of the sidewalls and keys or keyways for a plug or socket forming a member of a series according to an embodiment of the present invention.
FIG. 2 shows a series of plugs or sockets according to an embodiment of the present invention viewed in the same manner as in FIG. 1, some of which are of different heights to prevent mismatching of narrower plugs with wider sockets.
FIG. 3 shows a series of plugs or sockets according to an embodiment of the present invention viewed in the same manner as in FIG. 1, some of which have keys and keyways of different cross-sectional dimensions to prevent mismatching of narrower plugs with wider sockets.
FIG. 4 shows a number of plugs or sockets according to an embodiment of the present invention where the keyway is provided on the plug.
FIG. 5 shows a number of plugs or sockets according to an embodiment of the present invention where the keys and keyways are provided on the first pairs of sidewalls.

In FIG. 1 an end-on view of the engageable portion of a plug or alternatively of the corresponding socket recess opening is shown. Details such as terminals, catches and the like have been omitted for clarity and only the disposition of the sidewalls and key or keyway are shown. The engageable portion of the plug and the socket recess are preferably of constant cross-section though this is not essential provided the plugs can be readily inserted into and removed from their corresponding sockets. A first pair of opposed sidewalls separated by a width Wp and a second pair of opposed sidewalls separated by an height hp and disposed transversely, in this instance orthogonally, to the first pair of sidewalls, form the main body of the recess of engageable portion. The sidewalls in FIG. 1 are shown as flat surfaces. Whilst this is preferable it is not essential and other suitable contours may be used as required. On the upper one of the second sidewalls a key or keyway is provided of width $W_k$ and height $h_k$. If the keyway is to be provided on the plug, the plug and socket adopt the contour shown by the dotted line. In FIG. 1 the key or keyway is shown as being trapezoidal, whilst this shape is preferable it is not essential and other suitable cross-sections may be used. In the following description the views shown will be referred to as plugs. It is to be understood though, that the views are equally those of the recesses corresponding to the engageable portions of the plugs.

Figure 6:
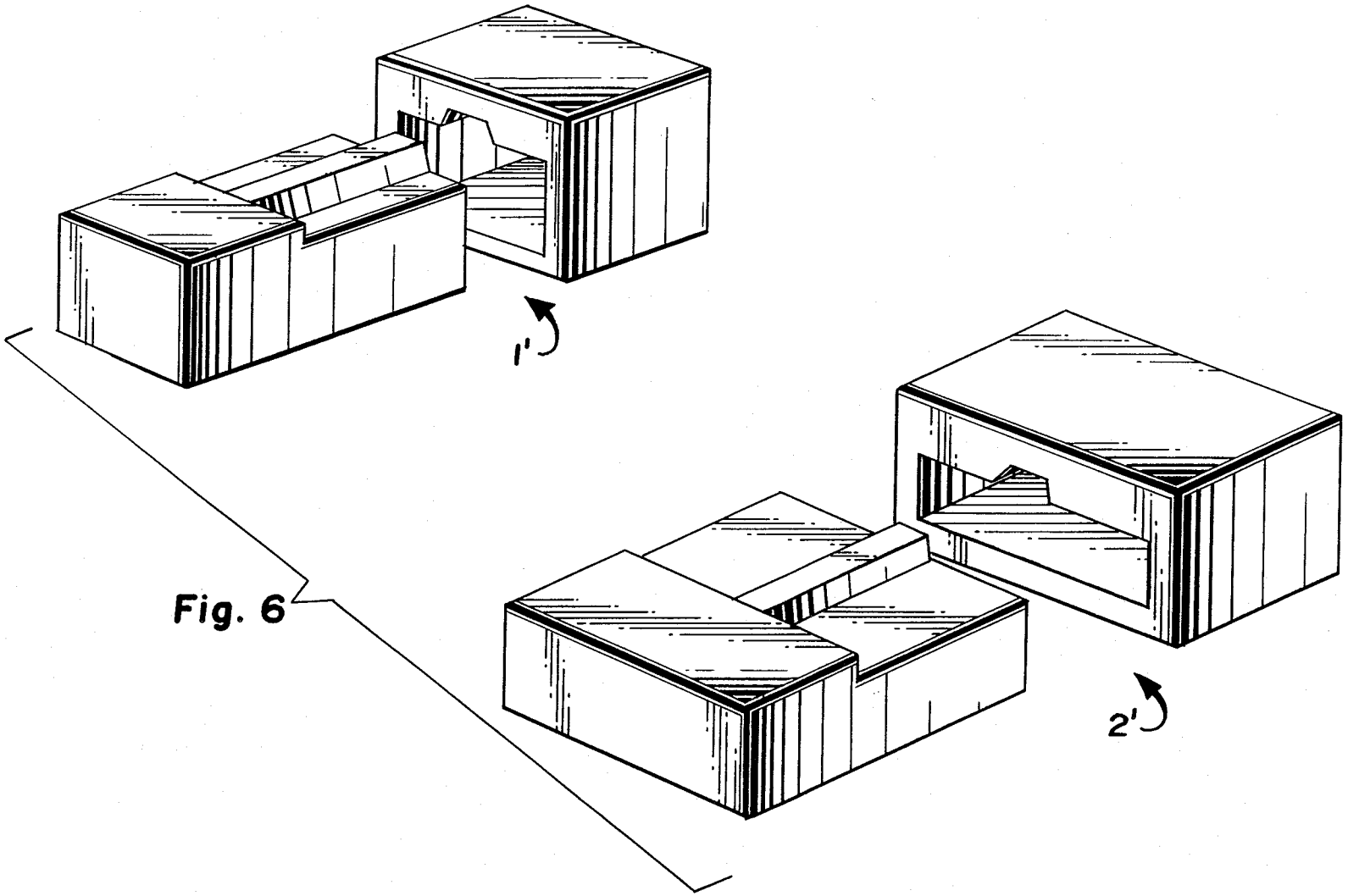
FIG. 6 shows perspective views of plug and socket assemblies corresponding to plugs 1 and 2 of the series shown in FIG. 2.

In FIG. 2 a series of plugs 1, 2, 3, 4 are shown for which the height $h_p$ increases with decreasing width Wp. Though the key cross-sectional dimensions are constant the narrower plugs e.g. 1 are prevented from insertion into sockets corresponding to the wider plug e.g. 2, 3, 4 by the variation in $h_p$. Perspective views of plug and socket assemblies 1' and 2' corresponding to plugs 1 and 2 in FIG. 2 are shown in FIG. 6. In the case of each member of the series of plugs 1, 2, 3, 4 two further sub-series of plugs may be defined by changing the position of the key on the upper sidewall or by changing its cross-sectional dimensions. The plugs 4, 5, 6 and 7 for example, are all of the same width Wp but will not fit into each others sockets due to the varying location of their keys along the upper second sidewall. Plugs 7, 8 and 9 again are all of the same width but will not fit into each other's sockets even though their keys are located at the same place along the upper second sidewall. This is because the cross-sectional dimensions of their keys are different. In this instance the width $W_k$ of the keyway increases as the height $h_k$ of the keyway decreases. Other suitable variations in the key cross-section may be used though to achieve the same effect.

In FIG. 3 a series of plugs are shown all having the same height $h_p$. In the case of plugs 10, 11, 12 and 13 which are all of different width Wp, the narrower plugs e.g. 10 are prevented from insertion into the sockets of the wider plugs e.g. 11, 12, 13 by their key heights $h_k$ increasing as their width $W_p$ decreases. Alternatively narrower plugs can be prevented from insertion into wider sockets by the width $W_k$ of the keyway being increased as the plug width Wp decreases. Such a series of plugs are 13, 14 and 15. Again in the case of each of the members of the above series a further sub-series of coding may be provided by altering the position of the keyway on the upper second sidewall as shown by plugs 15, 16 and 17 and also 10, 18 and 19.

In each of the above series the key is shown as being provided on the plug. However it may alternatively be located on the recess sidewall instead. In this case the variation of the key height $h_k$ and width $W_k$ with increasing plug width Wp is reversed with respect to that required when the key is on the plug. For example in FIG. 4 plugs 20 and 21 are two plugs of different widths with keyways provided on the recess lower second sidewall. Plug 20 cannot be inserted into the recess corresponding to plug 21 since the keyway in plug 20 is not of the same height $h_k$ as that of the key in the recess 21.

The key height $h_k$ is thus increased with increasing plug width Wp. Similarly plug 22 shows that to prevent narrower plugs from being inserted into wider plugs by variation of the key width $W_k$ the key width Wk must be decreased with decreasing plug width Wp.

FIG. 5 shows plugs where the key is located on one of the first sidewalls. This is quite acceptable for plugs where insertion of narrower plugs into wider sockets is prevented by variation of the plug height hp e.g. 23, 24. When the plugs and sockets are of the same height though e.g. 25, 26 the key width Wk may need to be unacceptably large. Plugs 24 and 25 however show that differentiation between plugs of the same width may still be achieved by varying the location of the key on the sidewall it is located on. The scope for such variation is restricted though when compared with that available when the key is located on the second sidewall. The second sidewall is generally longer than the first sidewall partly due to the common use of ribbon cables in the applications for which the connectors are primarily intended and mainly due to the linear arrangement of the terminals in the engageable portion of the plug. For these reasons the key and keyway are preferably always located on one of the second pairs of sidewalls.

We claim:

1. A series of electrical connector assemblies, each assembly comprising a socket and a corresponding plug, one member of each assembly having a single coding key, the other member of said assembly having a single keyway which is complementary to said single coding key; each plug having an engageable portion for engaging in a predetermined direction within a recess formed in said corresponding socket with said single coding key in mating engagement with said single keyway, said engageable portion comprising a first pair of opposed plug sidewalls and a second pair of opposed plug sidewalls disposed transversely to said first pair of plug sidewalls, said first pair and said second pair of sidewalls extending in said predetermined direction, said recess comprising a first pair of opposed recess sidewalls and a second pair of opposed recess sidewalls disposed transversely to said first pair of recess sidewalls, the width of said engageable portions and said corresponding recesses, as measured between said first pairs of sidewalls, being different for each of the assemblies of the series, wherein the heights of said engageable portions and recesses as measured between said second sidewalls are dimensioned to prevent insertion of a given plug of the series into any socket of the series having a recess width as measured between said first pair of recess sidewalls which is greater than the width between said first plug sidewalls of said given plug, the height of said engageable portion of said given plug being greater than the height of said any socket having such greater width, whereby inadvertent incorrect connection of plug and socket terminals is precluded by preventing mismatches between non-corresponding plugs and sockets in the series.

2. A series of assemblies according to claim 1 wherein said coding key and keyway are each of the same cross-sectional dimensions as viewed in the direction of engagement of said plug and socket for all members of said series.

3. A series of electrical connector assemblies, each assembly comprising a socket and a corresponding plug, one member of each assembly having a single coding key, the other member of said assembly having a single keyway which is complementary to said single coding key; each plug having an engageable portion for engaging in a predetermined direction within a recess formed in said corresponding socket with said single coding key in mating engagement with said single keyway, said engageable portion comprising a first pair of opposed plug sidewalls and a second pair of opposed plug sidewalls disposed transversely to said first pair of plug sidewalls, said first pair and said second pair of sidewalls extending in said predetermined direction, said recess comprising a first pair of opposed recess sidewalls and a second pair of opposed recess sidewalls disposed transversely to said first pair of recess sidewalls, the width of said engageable portions and said corresponding recesses, as measured between said first pairs of sidewalls, being different for each of the assemblies of the series, wherein the cross-sectional dimensions of said key and keyways of each assembly of said series as viewed in said predetermined direction are dimensioned to prevent insertion of a given plug of the series into any socket of the series having a recess width as measured between said first pair of recess sidewalls which is greater than the width between said first plug sidewalls of said given plug, said coding key and keyway of each assembly of said series having different cross-sectional dimensions, as viewed in said predetermined direction, from those of said coding key and keyway of all other assemblies of said series, whereby inadvertent incorrect connection of plug and socket terminals is precluded by preventing mismatches between non-corresponding plugs and sockets in the series.

4. A series of assemblies to claim 3 wherein said engageable portions of said plugs and said recesses of said sockets are of the same height as measured between said second pair of sidewalls for all members of the series.

5. A series of assemblies according to claim 4 wherein said coding key and keyway of each member of said series are of different width as than said coding key and keyway of all other members of said series.

6. A series of assemblies according to claim 3 or claim 4 wherein said coding key and keyway of each member of said series are of different height than said coding key and keyway of all other members of said series.

7. A series of assemblies according to claim 1 wherein said coding keys and keyways are located on said second sidewalls.

8. A series of assemblies according to claim 1 wherein said coding keys are located on said plugs and said coding keyways are located in said sockets.

* * * * *